US006024832A

United States Patent [19]

Trani et al.

[11] Patent Number: 6,024,832

[45] Date of Patent: Feb. 15, 2000

[54] METHOD AND APPARATUS FOR PRODUCING EXTENSIBLE PAPER

[75] Inventors: Giorgio Trani, Venice; Norberto Cariolaro, Carmignano di Brenta, both of Italy

[73] Assignee: Giorgio Trani Cartiere Cariolaro S. p. A., Italy

[21] Appl. No.: 08/930,432

[22] PCT Filed: Apr. 4, 1996

[86] PCT No.: PCT/EP96/01484

§ 371 Date: Oct. 7, 1997

§ 102(e) Date: Oct. 7, 1997

[87] PCT Pub. No.: WO96/31647

PCT Pub. Date: Oct. 10, 1996

[30] Foreign Application Priority Data

Apr. 7, 1995 [IT] Italy ..... VE95A0009

[51] Int. Cl.[7] ..... D21H 11/12; D21H 23/22

[52] U.S. Cl. ..... 162/13; 162/56; 162/92; 162/97; 162/99; 162/135; 162/261

[58] Field of Search ..... 162/13, 55, 23, 162/24, 56, 91, 92, 97, 99, 205, 265, 261, 361, 396

[56] References Cited

U.S. PATENT DOCUMENTS 3,290,209 12/1966 Ihrman ..... 162/361
3,454,463 7/1969 Welsh ..... 162/206

FOREIGN PATENT DOCUMENTS

0568404A1 11/1993 European Pat. Off. .
0631014A1 12/1994 European Pat. Off. .
WO94/08089 4/1994 WIPO .

*Primary Examiner*—Dean T. Nguyen
*Attorney, Agent, or Firm*—Hoffman Wasson & Gitler

[57] ABSTRACT

A method for producing extensible paper, comprising the following stages:

feeding a mix of vegetable fibres to a kneader member, mixing the mix with water in the kneader, beating the fibres to obtain a pulp, transferring the beaten pulp into a flow chest, feeding the beaten pulp from the flow chest onto a paper web formation cloth with consequent reduction of the water percentage by gravity and vacuum, pressing the web, with consequent further reduction of its water content, initial drying of the paper web to a substantially constant moisture content of between 15% and 65%, compacting, final drying to a moisture content of between 15% and 4%, preferably 10%–8%, glazing, wherein:

the beating stage is carried out by rubbing the fibres in a multistage unit to obtain a pulp having a degree of beating of at least 30° SR, the compacting stage is carried out between at least a pair of rollers of which one is of hard material comprising circunferential surface ribs and driven at greater speed, and the other is of soft material with a smooth surface and driven at lesser speed.

33 Claims, 2 Drawing Sheets

METHOD AND APPARATUS FOR PRODUCING EXTENSIBLE PAPER

FIELD OF THE INVENTION

This invention relates to a method for producing extensible paper and a plant for implementing the method.

DESCRIPTION OF THE PRIOR ART

U.S. Pat. No. 3,454,463 discloses a method of subjecting newsprint paper to controlled compressive shrinking including the features of passing the wire side of a web in contact with the moving smooth surface of a mechanical compactor and shrinking the newsprint web to a value substantially above the desired value and then stretching the web to the desired value.

EP-A-0631014 discloses a process for making soft tissue products.

An object of the invention is to provide a method enabling paper to be produced with a high degree of strength while at the same time with an extensibility both in the longitudinal direction and in the transverse direction of practically the same order of magnitude.

A further object of the invention is to provide a method enabling paper to be produced with a continuous plant.

A further object of the invention is to provide a method enabling producing paper with smooth surface in order to improve its printability characteristics.

BRIEF SUMMARY OF THE INVENTION

These and further objects which will be apparent from the ensuing description are attained according to the invention by a method for producing extensible paper, comprising the following stages:

feeding a mix of vegetable fibres to a kneader member,
mixing the mix with water in the kneader,
beating the fibres to obtain a pulp,
transferring the beaten pulp into a flow chest,
feeding the beaten pulp from the flow chest onto a paper web formation cloth with consequent reduction of the water percentage by gravity and vacuum,
pressing said web, with consequent further reduction of its water content,
initial drying of the paper web to a substantially constant moisture content of between 15% and 65%,
compacting,
final drying to a moisture content of between 15% and 4%, preferably 10%–8%,
glazing,
wherein:
said beating stage is carried out by rubbing the fibres in a multistage unit to obtain a pulp having a degree of beating of at least 30° SR,
said compacting stage is carried out between at least a pair of rollers of which one is of hard material comprising circunferential surface ribs and driven at greater speed, and the other is of soft material with a smooth surface and driven at lesser speed.

BRIEF DESCRIPTION OF THE DRAWINGS

A preferred embodiment of the present invention is described hereinafter with reference to the accompanying drawings, in which.

DESCRIPTION OF PREFERRED EMBODIMENTS

Figure 1:
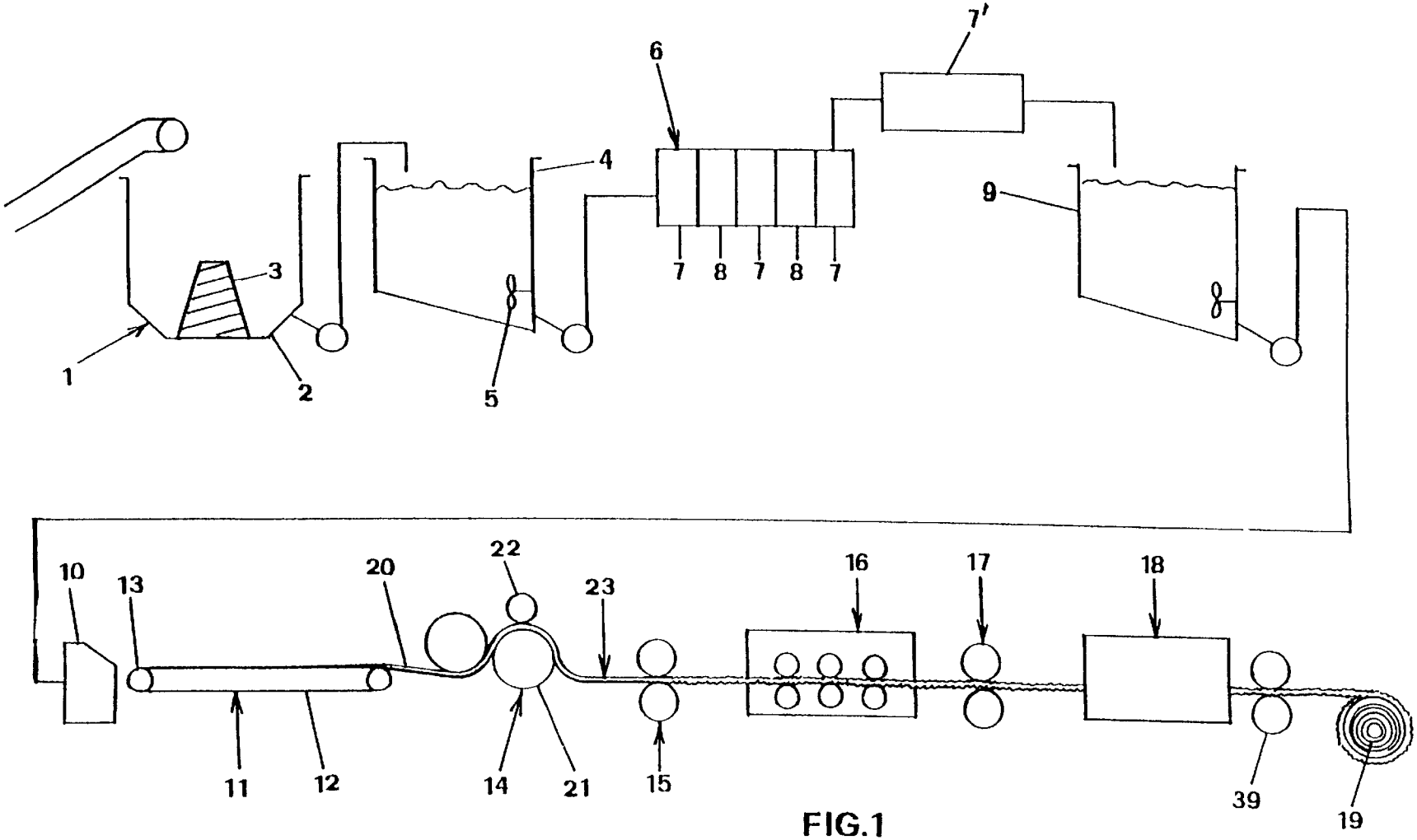
FIG. 1 is a schematic view of a plant for implementing the method of the invention.

As can be seen from the figures, the plant for producing extensible paper comprises essentially a high density kneader 1 consisting substantially of a cylindrical tank 2 with an inverted frusto-conical base and internally housing a conical impeller 3 comprising on its surface a helical projection.

The kneader 1 is connected to a storage vat 4 provided with a stirrer 5 and connected to a beating station 6 formed from beating units 7 of lava disc type alternating with storage chests 8. The exit from the last beating unit 7 is connected to a further high density beating unit 7' of perforated ring type connected to a storage vat 9 communicating with a flow chest 10 feeding a station 11 in which the paper web is formed. This station comprises a cloth 12 taut between two return rollers 13 and arranged to subject the pulp of water and fibrous raw materials to progressive water extraction by means of gravity and vacuum.

The downstream end of the paper web formation station 11 leads to a pressing station 14, downstream of which there are provided an impregnation station 23 and a successive preforming station 15.

Downstream of the preforming station 15 there is provided a drying station 16 of hot roller type which ensures a constant moisture content of the paper web of between 15% and 65%, preferably 50%, and a subsequent compaction station 17 comprising pairs of counter-rotating rollers of different type and surface consistency, driven at different speeds and able to compact the web both longitudinally and transversely. In particular the upper roller 37 of each pair is of metal, comprises a plurality of surface circumferential ribs 38 and rotates at greater speed than the corresponding lower roller 36 which is in rubber and has its surface smooth.

The exit of the compaction station 17 is connected to a further drying station 18, which is connected to a glazing station 39 connected to a successive paper winding station 19.

The drying station 18 ensures a water content of the paper web of between 4% and 15%, preferably 10%.

The purpose of the glazing station 39 is to improve the printability and bondability characteristics of the extensible paper obtained and operates with a linear load of between 10 and 100 kg/cm, preferably between 50 and 52 kg/cm.

Between the drying station 18 and winding station 19 there can be inserted a further impregnation station and a further drying station for subjecting the paper web to treatment to improve its printability characteristics, if required.

The plant according to the invention also comprises a series of controls and automation devices which ensure that the operating cycle is correctly implemented and which will be mentioned as required during the course of the following description.

The operation of the plant according to the invention will now be described with reference to the passage of the paper web under formation through the successive stations.

The bales of fibrous raw material are fed to the high density kneader 1 together with a predetermined quantity of water for their mixing. Here the pulp is kneaded, mixed with water and particular substances added, the purpose of which is to increase the ultimate strength of the fibres, to homogenize the water and fibre pulp and give special characteristics to the paper obtained.

In particular the fibrous raw material consists of vegetable fibres which can be long-fibre cellulose, short-fibre cellulose or other fibres obtained from vegetables other than wood (cotton linters, hemp, flax, esparto, kenaf). The different raw materials can be worked on the same line or preferably on different lines.

Rotating the impeller 3 results in progressive kneading of the fibrous raw material, which preserves the length of the original fibres and results in their intimate mixing with the water and the additives fed to the kneader. In particular, the additives used can include starches, which are able to bind the fibres together and increase their ultimate strength, or carboxymethyl-cellulose (CMC), the purpose of which is to disperse the fibres and hence prevent their coagulation, or synthetic and/or lactic resins the purpose of which is to bind the fibres together to form a sort of elastic bond.

A pulp of fibre, water and additives leaves the kneader 1 with a dry content of about 15%, this pulp being fed to the successive beating station 6 to be subjected to the action of the lava disc beating units 7, which work the fibres substantially without cutting them, but by hydrating them and by rubbing and conferring particular characteristics on the pulp. As a result of this treatment, the fibres are modified such as to facilitate their consolidation and to form a continuous and homogeneous structure, essential for the characteristics which the final product has to present.

The degree of beating of the pulp can be determined on the basis of objective parameters measured in SR (Shopper Reagler) units, and according to the present invention the pulp leaving the beating treatment must be between 30° SR and 60° SR according to the weight in grames of the paper to be obtained.

At the exit from the last beating stage the pulp, which as stated is between 30° SR and 60° SR, is fed into the perforated ring beating unit 7', which operates at a density of about 20% and the purpose of which is to hydrate the fibres, to swell and curl them. The pulp is then fed into the storage vat 9 and from here into the flow chest 10, from which with a dry content of about 0,5–1% it is poured onto the underlying cloth 12 of the paper web formation station 11.

On the initial portion of this cloth the pulp tends to progressively eliminate water, firstly by gravity and then by suction, until at the exit end of the cloth it has a dry content of about 18%.

The paper web 20 leaving the station 11 passes to the pressing station 14 between pressing rollers 21 and felts 22, losing water to attain a dry content of about 35%.

The paper web then passes to the impregnation station 23 where it is treated with a solution of various additives the purpose of which is to improve the extensibility characteristics of the paper and/or to improve the production technology. This impregnation is preferably effected by a spray device but can also be effected by other systems, for example by passing the forming paper web through tanks containing the impregnation solution. In either case the quantity of impregnating substance is controllable, with considerable advantages both in terms of cost of the substance used and in terms of exact determination of said substance.

Figure 2:
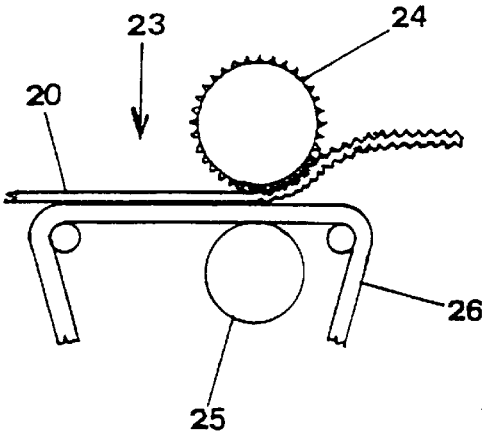
FIGS. 2, 3, 4 and 5 are schematic views showing different rollers used in the preforming stage.
Figure 3:
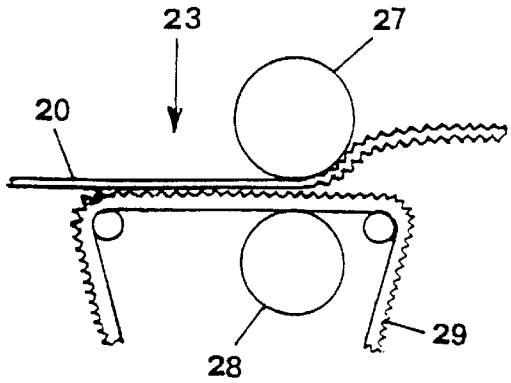
Figure 4:
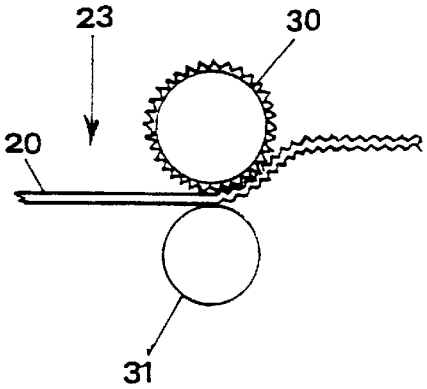
Figure 5:
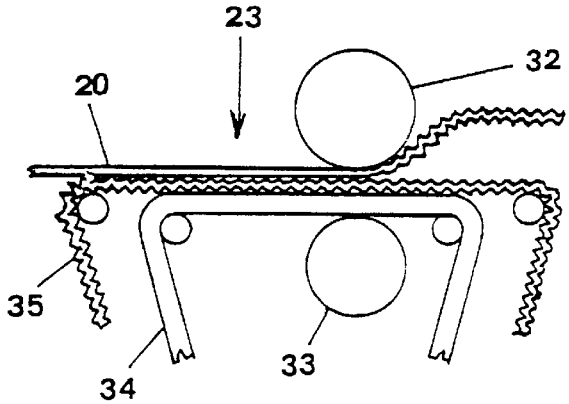

The web impregnated in this manner is subjected to preforming treatment in the station 15, in which one or more preforming units are provided. These can be all identical or different. In particular, each preforming unit can comprise:

an upper roller 24 with a shaped profile and a smooth roller 25 with traditional smooth felt 26 (FIG. 2);

a smooth upper roller 27 and a smooth lower roller 28, between which a felt 29 is interposed having an external marking structure to suitably deform the forming paper web interposed between said felt and the upper roller 27 (FIG. 3);

an upper roller 30 with a shaped profile and a smooth lower roller 31 (FIG. 4);

a smooth upper roller 32, a smooth lower roller 33, a traditional felt 34 and a felt 35 of marking structure interposed between the felt 34 and the upper roller 32 (FIG. 5).

The use of several preforming units, which can be identical or different, enables profiles practically of any design to be obtained on the paper web, and in particular designs not obtainable with a single preforming unit.

The paper web preformed in this manner is dried in the station 16 to a dry content of about 50–60% by passage through hot roller or a hot air tunnel, before being subjected to compaction.

In passing from the pressing station 14 to the compaction station 17 the roller speed is regulated so that the paper is subjected to a tension such as to undergo maximum longitudinal elongation compatible with its ultimate strength, in order to obtain transverse contraction of the paper, with a corresponding reserve of transverse extensibility.

Between the preforming station 15 and the drying station 16 there can be interposed a drying and/or fusion station, preferably of infrared type.

Figure 6:
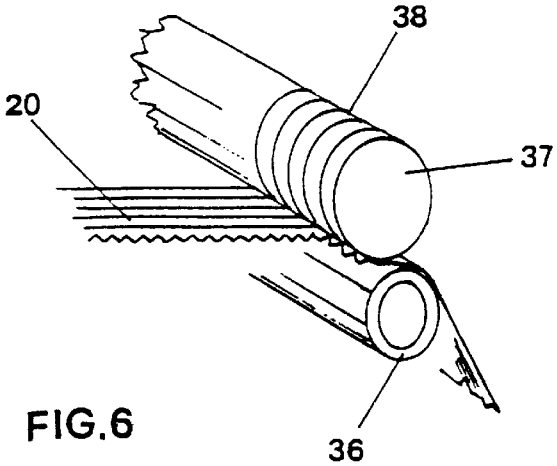
FIG. 6 is a schematic view showing the rollers used in the compaction stage.

In the station 17 the compaction, which occurs both in the longitudinal and in the transverse direction, is effected by passing the paper web between a pair of rollers (FIG. 6), of which the lower roller 36 is of rubber and is driven at a certain speed, whereas the upper roller 37 is of metal and comprising a plurality of surface ribs 38, for example circumferential, and rotates at greater speed. Because of the pressure effect and the configuration of the metal roller 37, cooperating with the rubberized surface of the other roller 36, the paper web is subjected to undulation in the transverse direction and at the same time, because of the different roller speeds, to a braking action by the rubberized roller and to a consequent compaction in the longitudinal direction.

On termination of this compaction stage the paper is subjected to further drying in the station 18 to achieve a dry content of about 85%, preferably 90%.

It should be noted that in passing from the compaction station to the exit of the drying station the roller speed is regulated (substantially constant) such that no traction stress is applied, so that the longitudinally compacted paper loses none of its longitudinal extensibility.

At the exit of the drying station 18 the paper web is subjected to glazing in the station 39.

The paper web obtained in this manner, in particular because of the beating, impregnation, preforming and compaction treatment, presents a high degree of mechanical strength and of extensibility both in the longitudinal direction and in the transverse direction, of the order of at least 16% transversely and at least 20% longitudinally, for paper having weight for grams included between 100 and 150 $g/m^2$.

I claim:

1. A method for producing extensible paper, comprising the steps of:

feeding a mix of vegetable fibers to a kneader member, mixing said mix with water in said kneader, beating said mix containing water by rubbing the vegetable fibers in a multistep unit to obtain a pulp having a degree of beating of at least 30° SR, transferring said beaten pulp into a flow chest, feeding said beaten pulp from said flow chest onto a paper web formation cloth with reduction of the water percentage by gravity and vacuum and forming a paper web, pressing said paper web with further reduction of the water content of said paper web, initial drying of said paper web to a constant moisture content of between 15% and 65%, compacting said paper web between at least a pair of rollers, one of said rollers being a hard material and having circumferential surface ribs and driven at first speed, and the other is of soft material with a smooth surface and driven at second speed, said second speed being less than said first speed, final drying of said paper web to a moisture content of between 4% and 15%, and glazing said paper web.

2. A method as claimed in claim 1, wherein said final drying is to a moisture content of 8–10%.

3. A method as claimed in claim 1, wherein said glazing step is done with a linear load of between 10 and 100 kg/cm.

4. A method as claimed in claim 1, wherein said glazing step is done with a linear load of between 50 and 52 kg/cm.

5. A method as claimed in claim 1, further comprising carrying out said initial drying step until a moisture content of 45–50% is reached.

6. A method as claimed in claim 1, further comprising the step of impregnating, said web with additives in solution to increase the extensibility characteristics of said paper web before initial drying.

7. A method as claimed in claim 1, further comprising a high density beating after said beating step.

8. A method as claimed in claim 1, and said initial drying step said impregnated web undergoes a preforming step to deform said web in accordance with a defined profile which enhances the extensibility of said web wherein between said impregnating step.

9. A method as claimed in claim 1, further comprising the step of subjecting said paper web to tension such as to give maximum longitudinal elongation compatible with its ultimate strength between said pressing step and said compaction step.

10. A method as claimed in claim 1, wherein no longitudinal traction is applied to the paper web, after said compaction step, at least until the moisture content of said web has fallen to below 4%.

11. A method as claimed in claim 1, wherein said kneader member is a high density kneader.

12. A method as claimed in claim 1, comprising a storage step of said fibers, between the beating step, and transferring said fibers to the flow chest.

13. A method as claimed in claim 1, impregnating said pressed web before initial drying step with additives in solution to improve the subsequent preforming treatment.

14. A method as claimed in claim 1, wherein the vegetable fibers comprise long-fibre cellulose.

15. A method as claimed in claim 1, wherein the vegetable fibers comprise short-fibre cellulose.

16. A plant for producing extensible paper comprising:

a kneader member where vegetable fibers are fed and mixed with water, a beating station for beating by rubbing the vegetable fibers in a multistep unit of discs of lavic material, a flow chest wherein the beaten fibers are transferred, a paper web formation station with a cloth which receives said beaten pulp and reduces the water percentage of said beaten pulp to form a paper web, a pressing station receiving said paper web for the subsequent further reduction of the water content, a first drying station receiving said paper web from the pressing station for drying said paper web, a compacting station comprising at least a pair of rollers for compacting said dried paper web, one of said rollers is a rubber material, the other roller which is of hard material, at least one of the hard rollers being provided with a plurality of circumferential surface ribs, a second drying station for further drying said dried paper web, and a glazing station for glazing said dried paper web.

17. A plant as claimed in claim 16, further comprising an impregnation station between said pressing station and said first drying station.

18. A plant as claimed in claim 17, comprising a preforming station downstream of said impregnation station.

19. A plant as claimed in claim 18, wherein said preforming station comprises at least one preforming unit.

20. A plant as claimed in claim 19, wherein said preforming unit comprises an upper roller of shaped profile and a smooth lower roller with smooth felt.

21. A plant as claimed in claim 19, wherein said preforming unit comprises a smooth upper roller and a smooth lower roller, with an interposed felt having an external marking structure.

22. A plant as claimed in claim 19, wherein said preforming unit comprises an upper roller of shaped profile and smooth lower roller.

23. A plant as claimed in claim 19, wherein said preforming unit comprises a smooth upper roller, a smooth lower roller, a first felt and a second felt of external marking structure interposed between the felt and the lower roller.

24. A plant as claimed in claim 17, wherein said impregnation station comprises of at least one tank containing an impregnating solution.

25. A plant as claimed in claim 24, wherein said impregnation station comprises elements for spraying said impregnating solution onto the paper web.

26. A plant as claimed in claim 16, wherein said kneader member is a high density kneader and comprises a cylindrical tank having an inverted frusto-conical base and housing a conical impeller comprising a relative helix on its surface.

27. A plant as claimed in claim 16, wherein beating units alternating with storage chests form said beating station.

28. A plant as claimed in claim 16, further comprising a second high density beating station of perforated ring type downstream of said beating station.

29. A plant as claimed in claim 16, wherein said paper web formation station comprises a cloth taut between return rollers and arranged to subject the pulp of water and fibrous raw materials to progressive water extraction by gravity, vacuum or both.

30. A plant as claimed in claim 16, wherein said pressing station comprises pressing rollers and felts.

31. A plant as claimed in claim 16, wherein said first drying station comprises an infrared heater.

32. A plant as claimed in claim 16, wherein said first drying station comprises a plurality of hot roller.

33. A plant as claimed in claim 16, wherein said first drying station comprises a hot air tunnel.

* * * * *